United States Patent [19]

Deulofeu

[11] Patent Number: 4,512,749

[45] Date of Patent: Apr. 23, 1985

[54] SYSTEM OF ARTICULATED LEGS FOR TOY FIGURES

[76] Inventor: Jorge Magri Deulofeu, Barcelona, Spain

[21] Appl. No.: 439,559

[22] Filed: Nov. 5, 1982

[30] Foreign Application Priority Data

Nov. 6, 1981 [ES] Spain ..... 261281[U]

[51] Int. Cl.[3] ..... A63H 3/36; A63H 3/12

[52] U.S. Cl. ..... 446/390; 446/321; 446/333

[58] Field of Search ..... 46/22, 128, 135 R, 161, 46/162, 163, 17; 3/17 R, 2, 21, 18; 446/97, 98, 333, 375, 376, 377, 378, 390, 321

[56] References Cited

U.S. PATENT DOCUMENTS

| | | | |
|---|---|---|---|
| 187,322 | 2/1877 | Schmetzer | 46/22 |
| 1,750,404 | 3/1930 | Herman | 46/162 |
| 2,812,616 | 11/1957 | Ford | 46/162 |
| 3,400,408 | 9/1968 | Garcia | 3/21 |
| 4,063,381 | 12/1977 | Deulofeu | 46/22 |
| 4,186,518 | 2/1980 | Luke | 46/128 |

FOREIGN PATENT DOCUMENTS

| | | | |
|---|---|---|---|
| 2034589 | 6/1980 | United Kingdom | 46/161 |

*Primary Examiner*—Robert A. Hafer
*Assistant Examiner*—Daniel Nolan
*Attorney, Agent, or Firm*—Bacon & Thomas

[57] ABSTRACT

An articulated leg system for a toy figure is disclosed in which the configuration represents the legs of an athlete when dressed in appropriate colors representing a sports team. Cylindrical rods, representing the legs of the toy figure, are integrally molded with a major diameter section of the figure which is received in a body cavity. The major diameter section extends below the body cavity and represents the athletic shorts or apparel of the figure. Received on the rod sections of the legs are sleeve means which define an exposed thigh section, horizontal stripes of a sock, and the shin portion of a sock. The assembly representing the various elements is prevented from accidental disassembly by a foot portion which is received on a radial ball of the cylindrical rod and defines a universal joint.

5 Claims, 4 Drawing Figures

FIG. 1
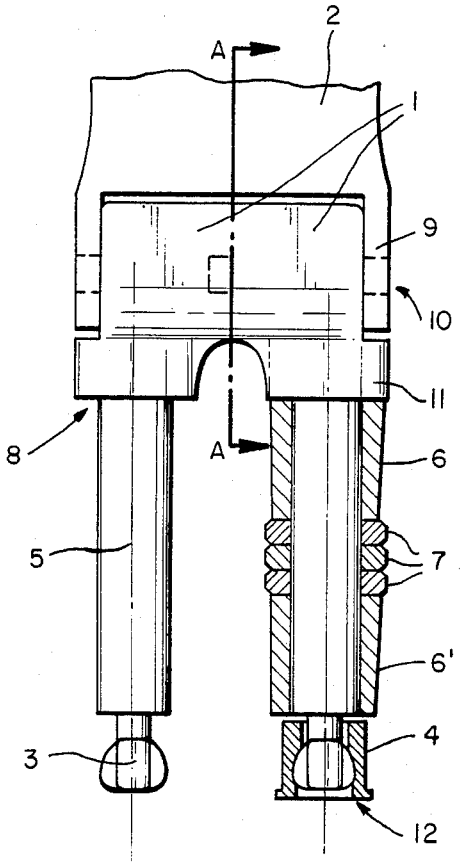
FIG. 2
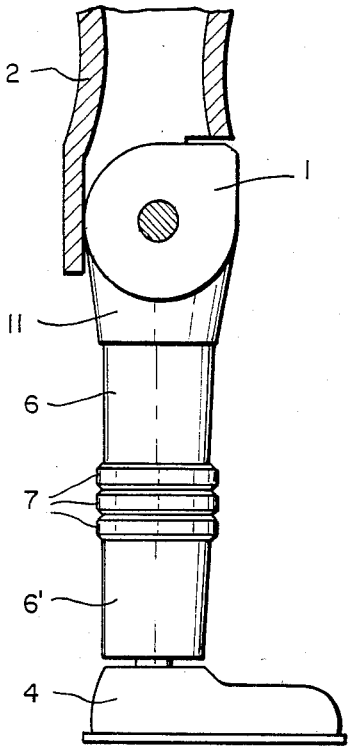
FIG. 3
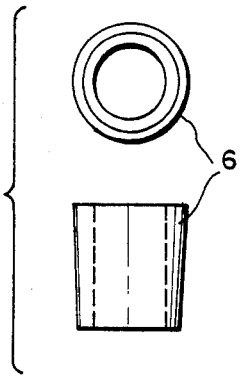
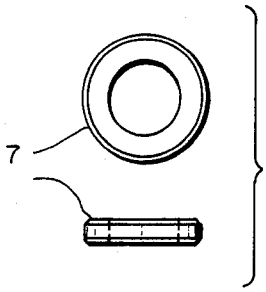
FIG. 4

SYSTEM OF ARTICULATED LEGS FOR TOY FIGURES

BACKGROUND OF THE INVENTION

The disclosure of the present application relates to a system of articulated legs for toy figures and will provide a practical and economical means by which the lower parts of the miniature figure may be produced. By the terms of the present disclosure, all previously required paint applications to the lower part of the figure may be omitted entirely.

SUMMARY OF THE INVENTION

The present invention sets forth a system of articulated legs for toy figures which can be produced in a practical and economical manner.

For purposes of illustration only, and by way of example, assume that the toy figure would represent a soccer player on a particular soccer team. As is well known, each team's uniform; comprising shirt, shorts and socks, have different colors. Each team's dress and appointments necessarily differ from those of all the other teams.

In this example, the soccer shorts would be of one color (white, black, red, green, etc.), followed by an expanse of the player's leg and then the socks with two or more horizontal stripes of a different color from that of the bottom of the socks. The proper flesh colorations for the legs alone, prior to the present disclosure, called for six careful applications of paint for each leg. This, combined with the requirements to paint the jersey in appropriate team colors adds tremendously to the cost of color-finishing the toy figure; thereby, making it an almost prohibitively expensive product.

Of known construction is Spanish Utility Model No. 214,210 entitled, "ARTICULATION FOR HIPS OF TOY FIGURES" and Spanish Utility Model No. 217,725 entitled, "ARTICULATION FOR FEET OF TOY FIGURES". The present invention, as specifically titled, addresses the structure of articulated legs whereby any previously required painting steps can be entirely omitted.

The legs are formed from two sections which articulate at the hips and with one another. The legs are molded in plastic of the same color as is needed for the soccer shorts.

Descending from the articulated hip joint, the leg is molded in two sections of different diameter. A large diameter section extends from the articulated hip joint to a point slightly below the articulated hip. A smaller diameter section, in the shape of a cylindrical rod, extends from the distal end of the larger diameter section. The distal end of the large diameter section defines the bottom portion or hem section of the soccer shorts. The smaller diameter section terminates in a radial ball. A foot section is adapted to receive the ball and defines, with the ball, an articulated ball joint. Thus, as in the example, if the soccer shorts are to be white, the leg pieces are molded in white plastic. The flesh appearance of the thigh section is created by a first sleeve section which is received on the cylindrical rod by sliding the sleeve section up the rod from the end which terminates in the radial ball. The upper end of the first sleeve section abuts the distal end of the large diameter section. Below the first sleeve section are located one or more ring sections which represent, by the colors of their material, the various horizontal colors of the stripes on the socks. The rings are added, to the cylindrical rods, in the same manner as the first sleeve section. Following the ring sections, a second sleeve, in the color of the bottoms of the socks, is then slipped over the cylindrical rod. In this regard, the terminology regarding "bottom of the socks" refers to any and all portions of the sock located below the ring sections.

The cylindrical rod is formed so as to be of slightly greater diameter than the special radial ball on which the foot is mounted to form the ball joint. This is done to permit easier installation of the first and second sleeves and the ring sections. Also, the total length of the two sleeves and the ring or rings section is designed to be equal to the length of the cylindrical rod, so that, after their assembly, the radial ball will extend beyond the second sleeve section so that the foot may be mounted thereon and form the ball joint.

The selection of appropriate colors, and the mounting of the sleeves and rings on the cylindrical rod leg pieces, as above described, will render the legs of a soccer player from a specific team.

BRIEF DESCRIPTION OF THE DRAWINGS

For better understanding of the disclosure of the present invention, the drawings set forth the disclosure in which:

FIG. 1 represents the front view of a system of articulated legs, one leg represented by a cylindrical rod and the other fitted with elements of the present invention which are shown in cross-section;

FIG. 2 represents the segment cut away by line A—A in FIG. 1;

FIG. 3 represents the side and top views of a sleeve used to simulate the bare thigh or the sock part below the ring sections; and, FIG. 4 represents side and top views of one of the rings used for the sock stripes.

DETAILED DESCRIPTION OF THE PREFERRED EMBODIMENT

FIG. 1 discloses a body cavity 2 in which the articulated leg system 8 is received. The articulated leg system 8 has a first section 1 which connects with downwardly extending flanges 9 of the body cavity section 2. The connection forms an articulated joint 10. The bottom of the first section 1 defines a distal end of a major diameter section 11 which represents the hem or bottom portion of the toy figure's soccer shorts. A smaller diameter section 5, defined by a cylindrical rod, extends from the distal end of the major diameter section 11. The lower end portion of the rod 5 terminates in a radial ball 3 which is received within a foot 4 so as to define a ball joint 12 which provides limited universal movement of the foot 4. The leg sections 1, 3 and 5, thus far described, are molded from plastic in one piece.

The cylindrical rod 5 is a support upon which a first sleeve section 6, simulating a bare thigh, is received. As shown in FIG. 3, the sleeve section 6 is externally in the shape of an inverted frustum of a cone.

From FIGS. 1 and 2, the rod 5 then receives one or more rings 7, of a predetermined length, which represent horizontal stripes on a sock, the shin portion of which is denoted at 6'. The rings 7 are shown in greater detail in FIG. 4. The sock shin portion 6' is defined by a second sleeve, similar to the previously described first sleeve 6, a major distinction between the two being that they are formed of different color material so as to delineate the different sections of the articulated leg system 8 thus far described.

The component parts 6, 7 and 6', representing the exposed thigh, colored ring sock section and the shin part of the sock, respectively, are assembled on and supported by the cylindrical rod 5 by sliding the component parts up the rod 5 until they abut the large diameter section 11. Once the parts 6, 7 and 6' are assembled on the rod 5, the foot 4 is snapped on the radial ball 3 to prevent accidental disassembly.

In addition to representing soccer players, the same arrangement clearly lends itself to the simulation of all other sportsmen, athletes or uniformed military personnel who dress with the legs exposed by shorts, and who wear colored socks or leggings.

While the invention has now been described in terms of certain preferred embodiments, the skilled worker in the art will recognize that there are various changes, omissions, modifications, and substitutions which may be made without departing from the spirit thereof. Accordingly, it is intended that the scope of the present invention be limited solely by that of the following claims.

What is claimed is:

1. An improved leg assembly for attachment to the body cavity of a toy figure comprising:

(a) a first section for connection to the body cavity of a toy figure to form an articulated joint therewith;

(b) a pair of major diameter sections extending from the first section for simulating the bottom portion of a pair of shorts;

(c) a smaller diameter section of cylindrical configuration, and including a free end, extending from each major diameter section for simulating the legs of the figure;

(d) plural sleeve sections of different colors slidably received on each smaller diameter section for simulating flesh coloration and socks worn by the figure; and (e) means engageable onto the free end of each smaller diameter section for simulating the feet of the figure and securing the sleeve sections on the smaller diameter sections.

2. The leg assembly of claim 1 wherein the plural sleeve sections include:

(a) a first sleeve section of flesh coloration in abutting engagement with the major diameter section;

(b) a second sleeve section defined by a plurality of separate rings for simulating the decoration of a sock;

(c) a third sleeve section for simulating the shin portion of the sock; and (d) wherein the second sleeve section is positioned between and in abutting engagement with the first and third sleeve sections.

3. The leg assembly of claim 1 wherein the first sleeve section is substantially in the configuration of a frustum of a cone.

4. The leg assembly of claim 1 wherein the free end of each smaller diameter section includes a radial ball.

5. The leg assembly of claim 4 wherein the first section, pair of major diameter sections, smaller diameter sections and radial ball are all integrally formed.

* * * * *